US007833360B2

(12) United States Patent
Kumano et al.

(10) Patent No.: US 7,833,360 B2
(45) Date of Patent: Nov. 16, 2010

(54) METHOD OF PRODUCING GRAIN-ORIENTED ELECTRICAL STEEL SHEET VERY EXCELLENT IN MAGNETIC PROPERTIES

(75) Inventors: Tomoji Kumano, Kitakyushu (JP); Shyuichi Yamazaki, Futtsu (JP); Osamu Tanaka, Kitakyushu (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 84 days.

(21) Appl. No.: 12/224,709

(22) PCT Filed: Jan. 12, 2007

(86) PCT No.: PCT/JP2007/050744

§ 371 (c)(1),
(2), (4) Date: Sep. 3, 2008

(87) PCT Pub. No.: WO2007/102282

PCT Pub. Date: Sep. 13, 2007

(65) Prior Publication Data

US 2009/0032142 A1 Feb. 5, 2009

(30) Foreign Application Priority Data

Mar. 7, 2006 (JP) ..... 2006-060660

(51) Int. Cl.
*H01F 1/147* (2006.01)

(52) U.S. Cl. ..... 148/113; 148/111

(58) Field of Classification Search ..... None
See application file for complete search history.

(56) References Cited

U.S. PATENT DOCUMENTS 2,599,340 A 3/1952 Littmann et al.

(Continued)

FOREIGN PATENT DOCUMENTS

JP 40-15644 7/1965

(Continued)

OTHER PUBLICATIONS

International Search Report dated May 1, 2007 issued in corresponding PCT Application No. PCT/JP2007/050744.

(Continued)

*Primary Examiner*—John P Sheehan
(74) *Attorney, Agent, or Firm*—Kenyon & Kenyon LLP

(57) ABSTRACT

The invention provides a method of producing a grain-oriented electrical steel sheet of the complete solid solution nitrided type that is good in glass film formation and excellent in magnetic properties, which method comprises: C: 0.025 to 0.09%, hot-rolling the steel slab containing Si: 2.5 to 4.0% and acid-soluble Al into a hot-rolled steel strip; controlling the rate at which N contained in the hot-rolled steel strip is precipitated as AlN to a precipitation rate of 20% or less; conducting hot-rolled strip annealing and cold rolling conducting decarburization-annealing combined with primary recrystallization by during the former part of the process in an atmosphere whose $PH_2O/PH_2$ is 0.30 to 0.70 and then during the latter part thereof in an atmosphere whose $PH_2O/PH_2$ is 0.20 or less, thereby making the circular equivalent average grain diameter of the primary recrystallization grains 7 μm to less than 18 μm; nitriding the strip as it travels in a mixed gas of hydrogen, nitrogen and ammonia; controlling the steel strip oxygen concentration before secondary recrystallization annealing calculated based on strip thickness of 0.30 mm (oxygen content: So) to 450 ppm to 700 ppm inclusive; applying a coat of annealing separator; and then conducting secondary recrystallization annealing in an atmosphere that, while the temperature at the hottest coil outer periphery point is between room temperature and 950° C., is controlled to a nitrogen atmosphere containing oxygen: 25 to 75% wherein the balance is hydrogen and $PH_2O/PH_2$ is 0.01 to 0.15.

7 Claims, 2 Drawing Sheets

U.S. PATENT DOCUMENTS

| | | | | |
|---|---|---|---|---|
| 5,244,511 | A | 9/1993 | Komatsubara et al. | |
| 6,280,534 | B1 * | 8/2001 | Senda et al. | 148/113 |
| 6,635,125 | B2 * | 10/2003 | Kosuge et al. | 148/307 |

FOREIGN PATENT DOCUMENTS

| | | |
|---|---|---|
| JP | 58-023414 | 2/1983 |
| JP | 05-112827 | 5/1993 |
| JP | 11-256242 | 9/1999 |
| JP | 11-279642 | 10/1999 |
| JP | 2000-199015 | 7/2000 |
| JP | 2001-152250 | 6/2001 |
| JP | 2003-166019 | 6/2003 |
| JP | 2003-342642 | 12/2003 |
| JP | 2005-226111 | 8/2005 |

OTHER PUBLICATIONS

J. D. Embury et al., "On Dislocation Storage and the Mechanical Response of Fine Scale Microstructures," *Acta metall. Mater.*, vol. 42, No. 6, pp. 2051-2056, 1994.

T. Kumano et al., "Influence of Primary Recrystallization Texture through Thickness to Secondary Texture on Grain Oriented Silicon Steel," *ISIJ International*, vol. 43, No. 3, pp. 400-409, 2003.

Y.Yoshitomi et al., "Prediction Method of Sharpness of {110}<001> Secondary Recrystallization Texture of Fe-3%Si Alloy," *Materials Science Forum*, vols. 204-206, pp. 629-634, 1996.

* cited by examiner

METHOD OF PRODUCING GRAIN-ORIENTED ELECTRICAL STEEL SHEET VERY EXCELLENT IN MAGNETIC PROPERTIES

FIELD OF THE INVENTION

This invention relates to a method of producing a grain-oriented electrical steel sheet mainly for use in the cores of transformers and the like.

DESCRIPTION OF THE RELATED ART

The magnetic properties of a grain-oriented electrical steel sheet can be classified into core loss, magnetic flux density and magnetostriction. When magnetic flux density is high, core loss property can be further improved utilizing magnetic domain control technology, and magnetostriction can also be reduced at high magnetic flux density. Transformers, the largest users of grain-oriented electrical steel sheet, can be made smaller in size when magnetic flux density is high because exciting current can be lowered at high magnetic flux density. Thus, increasing magnetic flux density and forming a superior glass film are the two key issues with regard to a grain-oriented electrical steel sheet.

A high-magnetic flux-density grain-oriented electrical steel sheet is typically produced by using AlN as the main inhibitor for secondary recrystallization. This production method can be broadly divided into four types based on the slab reheating condition during hot-rolling and the downstream nitriding for inhibitor strengthening: 1) complete solid solution, non-nitriding, 2) sufficient precipitation, nitriding, 3) complete solid solution, nitriding, and 4) incomplete solid solution nitriding. In the complete solution non-nitriding process of 1), slab heating is conducted at an ultrahigh temperature of 1350° C. or greater for an extended period and the kinds of inhibitor used are, for example, AlN, MnS, MnSe, Cu—S or Cu—Se, but nitriding prohibited. (See Japanese Patent Publication (B) No. 40-15644, Japanese Patent Publication (A) 58-23414, U.S. Pat. Nos. 2,599,340 and 5,244,511.) In the sufficient precipitation, nitriding process of 2), slab heating is conducted at a low temperature of 1250° C. or less, the kinds of inhibitor is primarily AlN, and downstream nitriding is essential. (See Japanese Patent Publication (A) 5-112827.) In the complete solid solution, nitriding of 3) and the incomplete solid solution, nitriding of 4), slab heating is conducted at an intermediate temperature of 1250 to 1350° C., the kinds of inhibitor used is, for example, AlN, MnS, Cu—S or Cu—Se, and downstream nitriding is essential. (See Japanese Patent Publication (A) 2001-152250 and Japanese Patent Publication (A) 2000-199015.)

It is known that a grain-oriented electrical steel sheet improved in Goss orientation intensity can be obtained using the complete solid solution nitriding process of 3) in which the inhibitor substance is completely dissolved in the course of the intermediate temperature slab heating, by restricting the N content at the time of steel refining, compensating for deficient AlN as secondary inhibitor by nitriding, and also dissolving inhibitor substances other than AlN, namely MnS, MnSe, Cu—S, Cu—Se and the like, in reduced amounts compared with the case of process 1). However, in this case, as in the precipitation nitriding process of 2), in order to form a good glass film it is necessary to increase the oxygen content of the decarburization-annealed steel sheet, but this leads to the problem of the secondary recrystallization becoming unstable when the oxygen content is increased. Although the reason for this is not certain, it is thought to occur because when excessive oxygen is present, Al oxidation inevitably occurs at the sheet surface and excessive nitrogen comes to be present in the nitrided sheet surface layer, which causes a relative decline in Al available to form AlN, so that AlN decomposition during secondary recrystallization annealing slows to impair the secondary recrystallization.

On the other hand, if the oxygen content of the decarburization-annealed steel sheet is simply reduced, the secondary recrystallization texture becomes very sharp but the amount of iron oxides, which play an important role in the glass film formation reaction, decreases, and environment shielding performance declines, so that forsterite coating formation becomes insufficient.

Moreover, regarding the complete solution non-nitriding process of 1), it is known from ISIJ, Vol. 43 (2003) No. 3, pp 400-409, Acta Mrtall., 42 (1004), 2053, and Material Science Forum Vol. 204-206, Part2: pp 631 that in the case where oxygen content is about 0.008 mass % during steel refining, Goss orientation sharpness decreases when nitriding is conducted between decarburization-annealing and the start of secondary recrystallization. It is also known that inferior secondary recrystallization occurs when the nitrogen content is low during steel refining.

Thus, while progress has been made in the establishment of production of grain-oriented electrical steel sheet excellent in magnetic properties, non-uniformity of temperature and atmosphere history with coil position in secondary recrystallization annealing make it very difficult for current production technology to achieve stable production of grain-oriented electrical steel sheet excellent in magnetic properties and glass film throughout the coil, so that the need for rigorous control of primary recrystallization annealing conditions is particularly great. Specifically, a method is adopted in which the temperature suitable for decarburization is established during the former part of primary recrystallization annealing when mainly decarburization is conducted and the temperature is raised during the latter part to adjust the atmosphere somewhat to the dry side for reforming (modifying) the oxide layer. However, when the temperature is increased during the latter part in the precipitation nitriding process of 2), the primary recrystallization grains enlarge and the resulting incomplete secondary recrystallization makes the process impractical.

SUMMARY OF THE INVENTION

Focusing on the fact that the complete solid solution nitriding process of 3) using AlN as the main inhibitor is currently the sharpest in Goss orientation texture, the inventors conducted an in-depth study based on this process with the aim of developing a grain-oriented electrical steel sheet very excellent in magnetic properties capable of overcoming the aforesaid problems. As a result, they acquired the following knowledge.

First, they discovered that when the steel sheet nitrogen content is small during steel refining, the downstream nitriding causes the inhibitor to assume a multi-stage inhibitor state comprising inherent inhibitor finely precipitated during the heat treatment prior to decarburization-annealing and acquired inhibitor formed by the nitriding, sharp Goss nuclei occur in the depth direction of the surface layer at the time of secondary recrystallization during finish annealing, and these secondary-recrystallize very preferentially to enable complete control of Goss orientation secondary recrystallization. Specifically, they discovered that by incorporating inhibitors other than AlN, i.e., MnS, MnSe, Cu—S, Cu—Se and the like, at contents smaller than in the conventional complete solid solution non-nitriding process of 1) to reduce downstream nitriding, it is possible to establish multi-inhibitor strength, namely, to make present finely precipitated AlN, finely precipitated (MnS, MnSe, Cu—S, Cu—Se and coarse AlN formed by downstream nitriding, thereby achieving a grain-oriented electrical steel sheet with very excellent magnetic properties not observed heretofore. They further discovered that the secondary inhibitor problem caused by unavoidable fluctuation of aluminum and nitrogen content at the steel refining stage can be solved by suitably defining the conditions of the annealing before final cold-rolling and nitriding conducted.

The present invention, which was accomplished based on the aforesaid knowledge, is an improvement on the complete solid solution nitriding process of 3) using AlN as the main inhibitor. In particular, it provides a method of producing a grain-oriented electrical steel sheet very excellent in magnetic properties by applying an intermediate slab heating temperature, suitably controlling the atmosphere and amount of oxygen in primary recrystallization annealing and the atmosphere in secondary recrystallization annealing, and regulating the hydrated water content and chlorine content of an annealing separator. The essence of the invention is as follows.

(1) A method of producing a grain-oriented electrical steel sheet very excellent in magnetic properties comprising: heating to a temperature of 1280° C. or more a steel slab including, in mass %, C: 0.025 to 0.09%, Si: 2.5 to 4.0%, acid-soluble Al: 0.022 to 0.033%, N: 0.003 to 0.006%, S and Se as S equivalent (Seq: S +0.405 Se): 0.008 to 0.018%, Mn: 0.03to 0.10%, Ti≦0.005%, and a balance of Fe and unavoidable impurities; hot-rolling the steel slab into a hot-rolled steel strip; controlling the rate at which N contained in the hot-rolled steel strip is precipitated as AlN to a precipitation rate of 20% or less; optionally conducting hot-rolled strip annealing; cold rolling the steel strip to a final sheet thickness in one cold rolling pass or more cold rolling passes with intermediate annealing or heat-treating it one or more times before final cold-rolling and making the final cold-rolling reduction ratio 83% to 92%; conducting decarburization-annealing combined with primary recrystallization by during the former part of the process soaking for 60 sec to 200 sec at a temperature of 810 to 890° C. in an atmosphere whose $PH_2O/PH_2$ is 0.30 to 0.70 and then during the latter half thereof soaking for 5 sec to 40 sec at a temperature of 850 to 900° C. in an atmosphere whose $PH_2O/PH_2$ is 0.20 or less, thereby making the circular equivalent average grain diameter of the primary recrystallization grains 7μm to less than 18μm; nitriding the strip as it travels in a mixed gas of hydrogen, nitrogen and ammonia to make the total nitrogen content of the steel strip 0.013 to 0.024%; controlling the steel strip oxygen concentration before secondary recrystallization annealing calculated based on strip thickness of 0.30 mm (oxygen concentration: So) to 450 ppm to 700 ppm inclusive; applying a coat of annealing separator composed mainly of MgO; and then conducting secondary recrystallization annealing in an atmosphere that, while the temperature at the hottest coil outer periphery point is between room temperature and 950°C., is controlled $PH_2O/PH_2$ is 0.01 to 0.15 in a hydrogen atmosphere containing nitrogen: 25 to 75%.

Here, So is the numerical value obtained by multiplying the actual oxygen analysis value (S: ppm) by t/0.30, namely, So (ppm)=S×t/0.30, where t (mm) is the actual steel strip thickness.

(2) A method of producing a grain-oriented electrical steel sheet very excellent in magnetic properties according to (1), wherein during the secondary recrystallization annealing the hottest coil outer periphery point is 950° C. or higher and the annealing atmosphere $PH_2O/PH_2$ is ≦0.01.

(3) A method of producing a grain-oriented electrical steel sheet very excellent in magnetic properties according to (1) or (2), wherein the steel sheet further comprises, in mass %, one or more of Cu: 0.05 to 0.30%, Sn: 0.02 to 0.30%, Sb: 0.02 to 0.30%, P: 0.02 to 0.30%, Cr: 0.02 to 0.30%, Ni: 0.008 to 0.3%, Mo: 0.008 to 0.3% and Cd: 0.008 to 0.03%.

(4) A method of producing a grain-oriented electrical steel sheet very excellent in magnetic properties according to (1) or (2), wherein the hydrated water content of the annealing separator is 2.0% or less.

(5) A method of producing a grain-oriented electrical steel sheet very excellent in magnetic properties according to (1) or (2), wherein a chlorine compound is added to the annealing separator to make the total chlorine content 0.020 to 0.080 mass %.

(6) A method of producing a grain-oriented electrical steel sheet very excellent in magnetic properties according to (5), wherein the relationship between the hydrated water content and chlorine content of the annealing separator satisfies the following equations:

$$\text{Clmax(mass \%)} = -0.04 \times \text{hydrated water content} + 0.1,$$

$$\text{Clmin(mass \%)} = -0.04 \times \text{hydrated water content} + 0.06,$$

$$0.5 \text{ mass \%} \leqq \text{hydrated water content} \leqq 2.0 \text{(mass \%)}, \text{ and}$$

$$0.020 \text{ mass \%} \leqq \text{chlorine} \leqq 0.080 \text{ mass \%}.$$

DETAILED DESCRIPTION OF THE INVENTION

Figure 1:
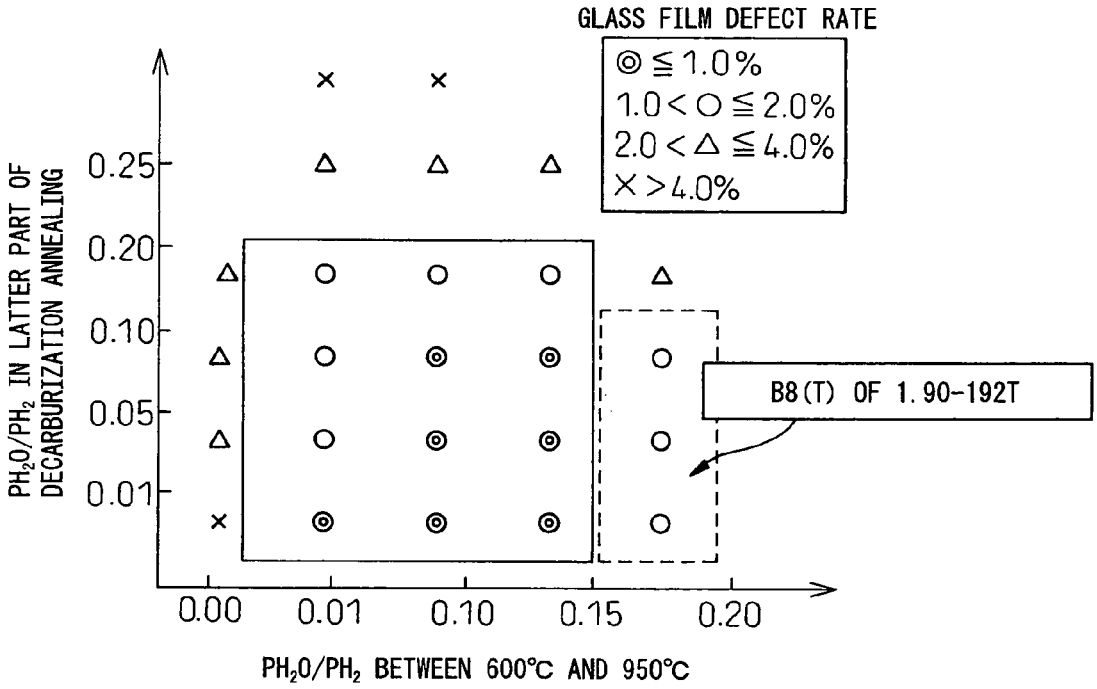
FIG. 1 is a diagram showing $PH_2O/PH_2$ and glass film defect rate during the latter part of decarburization-annealing and secondary recrystallization annealing.

Explanation will first be made regarding the chemical compositions of the steel defined by the present invention and the contents thereof. All contents are expressed in mass %.

The primary recrystallization texture is incomplete when C content is less than 0.025% and decarburization is difficult when it exceeds 0.09%, so that the steel is not suitable for industrial production.

Good core loss property cannot be achieved when Si content is less that 2.5% and cracking occurs to make cold-rolling extremely difficult when it exceeds 4.0%.

S and Se combine with Mn and Cu and precipitate finely to form precipitation inhibitors that are also effective as AlN precipitation nuclei. Addition of 0.008 to 0.018% as S equivalent (Seq: S+0.405 Se) is required. Secondary recrystallization is incomplete when S equivalent is less than 0.008% and S equivalent of greater than 0.018% is not practical because it necessitates slab heating at an ultrahigh temperature of 1420° C. for completely dissolving S and Se in solid solution.

Acid-soluble Al combines with N to form AlN that functions chiefly as primary and secondary inhibitor. Some of the AlN is formed before nitriding and some during high-temperature annealing after nitriding. Acid-soluble Al must be added to a content of 0.022 to 0.033% to obtain the required total amount of AlN formed for two kinds of the inhibitors. Goss orientation sharpness is inferior when acid-soluble Al content is less than 0.022% and the slab heating temperature must be set very high when it exceeds 0.033%.

Moreover, finely precipitated sulfides, selenium compounds and AlN act as primary and secondary inhibitors in the present invention. AlN contained in the slab therefore also plays an important role in controlling primary recrystallization. As a result, primary recrystallization grain control is difficult when N content for forming AlN is less than 0.003%, while Goss orientation sharpness decreases during nitriding when it exceeds 0.006%.

When Mn content is less than 0.03%, yield declines because the steel strip easily cracks during hot-rolling, and secondary recrystallization is unstable owing to deficiency inhibitor strength. On the other hand, when it exceeds 0.10%, MnS and MnSe become abundant to make the degree of solid solution uneven between different steel sheet locations, so that the desired product cannot be consistently obtained.

When Ti is added in excess of 0.005%, it combines with N in the steel to form TiN. This results in a substantially low N steel and causes inferior secondary recrystallization because the desired inhibitor strength is not achieved. The upper limit of Ti content is therefore defined as 0.005%.

Even when the slab of the composition defined by the present invention is hot-rolled after heating to 1280° C. or higher, the Cu therein functions to produce primary and secondary inhibitor effects by rapidly forming fine precipitates together with S and Se during cooling. In addition, the precipitates act as precipitation nuclei that improve AlN dispersion uniformity and also serve as secondary inhibitors, thereby producing a secondary recrystallization enhancing effect. These effects are slight when the Cu content is less than 0.05%, while at a content exceeding 0.30%, the effects saturate and surface flaws called "copper scabs" are likely to occur during hot-rolling.

Sn, Sb and P improve primary recrystallization texture. This improving effect is not observed at a content of less than 0.02%. At a content exceeding 0.30%, formation of a stable forsterite film (glass film) is difficult. Sn, Sb and P are also grain boundary segregation elements that work to stabilize secondary recrystallization.

Cr is effective for forming a forsterite film (glass film). Oxygen is hard to secure when the Cr content is less than 0.02% and good glass film formation is impossible when it exceeds 0.30%, Ni, Mo and Cd can be additionally added. These elements are automatically mixed in the case of electric furnace refining. Ni is markedly effective for uniformly dispersing precipitates as primary and secondary inhibitors and, as such, helps to stabilize magnetic properties. It is preferably added to a content of 0.02 to 0.3%. When Ni is added in excess of 0.3%, oxygen enrichment is not readily achieved following decarburization-annealing, so that forsterite film formation becomes difficult. Mo and Cd contribute to inhibitor strengthening by forming sulfides and selenium compounds. However, this effect is not observed at contents of less than 0.008%, while addition in excess of 0.3% causes precipitate coarsening that prevents realization of inhibitor function and makes magnetic property stabilization difficult.

The production conditions of the grain-oriented electrical steel sheet according to the present invention will now be explained.

Molten steel of the chemical composition stipulated by the present invention is cast by continuous casting or ingot casting and slabbing to obtain a slab of 150 to 300 mm thickness, preferably 200 to 250 mm thickness. Alternatively, thin slab casting for obtaining a thin slab of 30 to 100 mm thickness or strip casting for obtaining a direct cast strip can be employed. However, the thin slab casting method and the like present a difficulty in the point that the occurrence of center segregation during solidification makes it hard to obtain a uniform solidified state. So in order to obtain a uniformly solidified slab, the slab is preferably once subjected slab heating as a solution treatment prior to hot-rolling. The temperature condition for slab heating prior to hot-rolling is important. Specifically, inhibitor substances must be dissolved into solid solution at a temperature of 1280° C. or higher. When the temperature is below 1280° C., the precipitated state of the inhibitor substances in the slab becomes ununiform to give rise to skid marks. Although no upper limit of slab heating temperature is stipulated, the practical upper limit is 1420° C. Although complete solution treatment can be achieved by induction heating at a suitable temperature without heating up to the ultrahigh temperature of 1420° C. during slab heating, heating by a means such as ordinary gas heating, induction heating or ohmic heating is also possible. For these heating means, it is possible from the viewpoint of realizing the desired morphology to carry out breakdown rolling on the cast slab. Further, when the slab heating temperature becomes 1300° C. or higher, it is advantageous to apply the aforesaid breakdown treatment for improving texture.

The slab heated in the foregoing manner is then hot rolled. In the hot rolling, the precipitation rate of AlN in the steel strip must be held to 20% or less. When the precipitation rate of AlN in the steel strip exceeds 20%, the secondary recrystallization behavior in the steel strip varies with location, making it impossible to obtain a grain-oriented electrical steel sheet of high flux density.

Annealing before final cold rolling is conducted chiefly for the purpose of homogenizing the steel strip texture produced during hot rolling and achieving finely dispersed precipitation of inhibitors. However, the annealing can conducted with respect to the hot-rolled steel strip or prior to final cold rolling. In other words, one or more continuous annealing process are preferably conducted for heat history homogenization in hot rolling before final cold rolling. The maximum heating temperature in this annealing markedly affects the inhibitors. When the maximum heating temperature is low, the primary recrystallization grain diameter is small, and when it is high, the primary recrystallization grain diameter is coarse. The annealed steel strip is next cooled. This cooling is for securing fine inhibitor and also for securing a hard phase composed mainly of bainite. The cooling rate in this case is preferably 15° C./sec or greater.

The annealed steel strip is then cold-rolled at a reduction or 83% to 92%. When the cold rolling reduction is less than 83%, a high magnetic flux density structure is not obtained because the texture is broadly dispersed. When it exceeds 92%, {110}<001> texture diminishes extremely, causing the secondary recrystallization to become unstable. The cold-rolling is usually conducted at ordinary temperature. However, for the purpose of achieving enhanced magnetic properties through improvement of the primary recrystallization texture, it is effective to conduct one or more warm rolling passes with the temperature held at, for instance, 100 to 300° C. for 1 min or longer.

After the cold-rolling, the steel strip is decarburization annealed. In the decarburization annealing, the heating rate between room temperature and 650 to 850° C. is made 100° C./sec or greater. This is because a heating rate of 100° C./sec or greater, preferably 150° C./sec or greater, works to increase the Goss orientation in the primary recrystallization texture, thereby reducing the secondary recrystallization grain diameter. Means for achieving this heating rate include, for example, resistance heating, induction heating and direct heating. Any such means is usable.

The primary recrystallization and decarburization-annealing conditions that are the main features of the present invention will now be explained. In the present invention, annealing is conducted for improving the quality of the oxide-layer after decarburization and achieving the prescribed oxygen content. The oxide-layer after decarburization greatly affects glass film formation and the secondary recrystallization behavior during the ensuing secondary recrystallization annealing. Namely, the magnetic properties in the complete solid solution nitriding process of 3) are very good, but simultaneous realization of good glass film formation is difficult. This is thought to be related to the fact that the absolute amount of primary inhibitor formed by the complete solid dissolution is smaller than in the complete solid solution non-nitriding process of 1) so that the glass film formation during secondary recrystallization annealing markedly affects the secondary recrystallization. The fine control of secondary recrystallization and glass film formation therefore need to be separated and each conducted under rigorous conditions. Since the secondary recrystallization annealing is conducted batchwise in the coiled state, it is very difficult to conduct identical atmosphere and temperature history control at every region of the coil. This makes it hard to obtain a uniform secondary recrystallization structure. The inventors therefore carried out an in-depth study for designing the individual secondary recrystallization annealing control factors based on the threshold reactions.

The required properties of the oxide-layer are: i) presence of an absolute oxygen content for formation of a glass film composed mainly of MgO and forsterite, ii) presence of iron oxides as reaction promoters for the forsterite formation reaction, and iii) establishment of sealing property for preventing deterioration of the oxide-layer during secondary recrystallization annealing up to forsterite formation. Since 1) merely involves a chemical reaction, the required oxygen content can be controlled by the partial water vapor pressure $PH_2O/PH_2$, one of the decarburization-annealing conditions and can be regulated by the partial water vapor pressure and decarburization-annealing temperature during the former part of the decarburization-annealing. In this, condition is required for acquiring the desired primary recrystallization grain diameter and a C content of 0.0030% or less. Further, since the forsterite formation reaction is a reaction at the sheet surface, it can theoretically be assessed by "oxygen content/area" but it is in fact technically difficult to assess it using only the oxygen content at the sheet surface, so assessment is done using (oxygen content in steel sheet total thickness)/volume (weight). In the present invention, therefore, the oxygen content is evaluated with reference to a certain specified sheet thickness: 0.30 mm. The oxygen content after decarburization-annealing is substantially determined by the oxygen imparted under the annealing conditions during the former part of the decarburization-annealing. Specifically, oxygen calculated based on strip thickness of 0.30 mm (oxygen content: So) is the numerical value obtained by multiplying the actual oxygen analysis value (S: ppm) by t/0.30, namely, So (ppm)=S×t/0.30, where t (mm) is the actual steel strip thickness.

With regard to the complete solid solution nitriding method of the present invention, it was found that when the aforesaid oxygen content is 450 to 700 ppm, if two-step annealing is conducted to attain the oxygen content, a dense $SiO_2$ film is formed on the steel sheet surface to establish sealing property during secondary recrystallization annealing, and was further found that the aforesaid oxygen content is adequate as the amount of oxygen required by the chemical reaction for forming forsterite. When the oxygen content is less than 450 ppm, forsterite formation is incomplete and a good glass film cannot be obtained. When it is greater than 700 ppm, the excess oxygen oxidizes the Al of the inhibitor AlN to diminish the inhibitor strength and thereby make the secondary recrystallization unstable. In a case where the purpose is merely to form a glass film, the upper limit of oxygen content can be higher than 700 ppm without causing a problem. However, when, as in the present invention, good magnetic properties and glass film formation are both to be achieved, it is important to utilize the secondary recrystallization annealing to take advantage of a minimum required good quality oxide-layer, and for sufficiently conducting the forsterite formation reaction, the role of the reaction promoters, namely the formation of good quality iron oxides and a dense layer, is important. For this, if the oxide-layer formed at a relatively high partial water vapor pressure in the former part is treated in the latter part at a higher temperature and lower partial water vapor pressure than in the former part, the outermost layer is reformed (modified) to a suitable degree and good quality iron oxides (mainly fayalite) and a dense silica layer are formed in addition. When an oxide-layer is formed by this method, the forsterite reaction is promoted during secondary recrystallization annealing, thus giving rise to the advantage of enabling low-temperature vitrification. Further, the silica layer is densified, thus making it possible to prevent deterioration of the oxide-layer owing to unavoidable variation of the atmosphere during secondary recrystallization annealing. When the glass film is formed at a low temperature in this manner, fluctuation of the inhibitor strength for the secondary recrystallization decreases so that the inhibitor function can be thoroughly exhibited to achieve good magnetic properties as well.

The present invention is characterized in that during the former part of the decarburization-annealing the steel strip is soaked for 60 sec to 200 sec at a temperature of 810 to 890° C. in an atmosphere whose $PH_2O/PH_2$ is made 0.30 to 0.70 and then during the latter part of the decarburization-annealing the steel strip is soaked for 5 sec to 40 sec at a temperature of 850 to 900° C. in an atmosphere whose $PH_2O/PH_2$ is 0.20 or less, thus conducting decarburization-annealing combined with primary recrystallization to make the circular equivalent average grain diameter of the primary recrystallization grains 7 to less than 18 μm. Specifically, if the $PH_2O/PH_2$ of the atmosphere during the former part of the decarburization-annealing is less than 0.30, decarburization is insufficient, and if it exceeds 0.70, the silica layer thickens and the secondary recrystallization becomes unstable even if the treatment during the latter part is conducted properly. However, since the present invention is of the complete solid solution type, the annealing temperature is defined as 810 to 890° C., preferably 830 to 860° C., ranges in which decarburization readily proceeds, high primary inhibitor strength, because the annealing temperature does not affect the primary recrystallization grain diameter. Decarburization annealing must be conducted within the aforesaid temperature range because an annealing temperature of less than 810° C. or greater than 890° C. decarburization becomes difficult. When the soaking time in the decarburization-annealing is under the lower limit, the decarburization and oxide-layer improvement are insufficient. When it is greater than the upper limit, no particular problem is experienced regarding quality, but productivity declines and cost increases. Such a time is therefore desirably avoided. Further, $PH_2O/PH_2$ in the latter part of the decarburization-annealing is fundamentally for reforming the oxide-layer and additionally forming a dense oxide-layer (fayalite, $SiO_2$) in the latter part annealing, and is defined as 0.20 or less. Although the annealing temperature conditions during the latter part can be made the same as those during the former part, a high temperature is preferable for enhancing reactivity and improving productivity. Therefore, also in view of the process being of the complete solid solution type, the upper limit of the annealing temperature can be defined as 900° C. When the annealing temperature conditions are exceeded, grain growth occurs following primary recrystallization and makes the secondary recrystallization unstable. Moreover, the effect of the latter part annealing temperature beings less than 850° C. is only that silica formation takes more time.

It is reported that in the precipitation nitriding process of 2) the average primary recrystallization grain diameter following completion of decarburization-annealing is ordinarily 18 to 35 μm, while it is 7 μm to less than 18 μm in the present invention. The average diameter of the primary recrystallization grains is an important factor affecting magnetic properties, particularly core loss property. Specifically, from the viewpoint of grain growth, when the primary recrystallization grains are small, the volume fraction of Goss-oriented grains that act as secondary recrystallization nuclei at the primary recrystallization stage increases, and since the grain diameter is small, the number of Goss nuclei becomes great in proportion. As a result, the absolute number of Goss nuclei is about 5 times greater in the present invention than in the case of an average primary recrystallization grain diameter of 18 to 35 μm, so that the secondary recrystallization grain diameter becomes comparatively small, thereby markedly improving core loss property.

Moreover, in comparison with the precipitation nitriding process of 2), the average primary recrystallization grain diameter is small, and when the amount of nitriding is small, the secondary recrystallization driving force increases to initiate secondary recrystallization at a low temperature, so that secondary recrystallization starts at a low temperature in an early stage of temperature increase in the final finish annealing. Owing to this, in the actual state of the secondary recrystallization annealing being conducted in the coiled condition, the temperature history, including the temperature increase rate up to the maximum temperature at regions throughout the coil, becomes the same, thereby making it possible to avoid ununiformity of structure and secondary recrystallization at every region of the coil.

The steel strip is nitrided as it travels continuously through a nitriding unit maintained at a uniform ammonia atmosphere concentration. Owing to the low secondary recrystallization temperature, both sides are equally nitrided within a short time. An indispensable condition of the present invention, which adopts the complete solid solution nitriding process, is that the steel strip be subjected to nitriding treatment after decarburization-annealing and before the start of secondary recrystallization. Nitriding processes include, for example, that of mixing a nitride such as CrN, MnN or the like into the annealing separator at the time of high-temperature annealing and that of nitriding the steel strip after decarburization-annealing by passing it through an atmosphere including ammonia. Although either of these processes can be adopted, the latter is more practical in industrial production. The amount of nitriding is a function of the amount of N available for combining with acid-soluble Al. When the amount of nitriding is low, the secondary recrystallization is unstable, and when it is high, many glass film defects that expose the base metal occur and the Goss orientation density declines. Therefore, in order to obtain the high flux density that is the object of the present invention, the total nitrogen content of the steel strip after nitriding is defined as 0.013 to 0.024%.

The secondary recrystallization annealing conditions will now be explained.

In the method of producing the steel sheet according to the present invention, the secondary recrystallization start temperature is lower than in the precipitation nitriding process of 2). The temperature of 950° C. at the hottest point is therefore the temperature controlled during secondary recrystallization annealing. The heating atmosphere up the coil hottest point temperature of 950° C. is defined as being 25 to 75% nitrogen and the balance of hydrogen. The hydrogen can be replaced with an inert gas such as argon but hydrogen is preferable in terms of cost. Since the nitrogen is for forming AlN, it is necessary for inhibitor control. When the heating atmosphere contains less that 25% nitrogen, denitrification occurs to weaken the inhibitor and make secondary recrystallization unstable. When it contains greater than 75% nitrogen, the oxide-layer is additionally oxidized after decarburization-annealing, so that a poor quality oxide-layer is formed and the glass film is inferior. Up to a coil hottest point temperature of 950° C., a certain amount of oxidizing atmosphere is effective for glass film formation, so in such a case, the atmosphere $PH_2O/PH_2$ is defined as 0.01 to 0.15. At a coil hottest point temperature exceeding 950° C., a dry atmosphere is required to prevent additional oxidation of the steel sheet surface. In this case, the atmosphere $PH_2O/PH_2$ is defined as 0.01 or less.

Discharge of moisture from the annealing separator occurs from about 600° C. and the mass effect of the coil causes the time of the temperature history at the coil location to vary. Control of the atmosphere $PH_2O/PH_2$ while the coil hottest point temperature is between 600 and 950° C. is therefore important. As in the part, the annealing separator required a certain amount of hydrated water content because the oxide-layer after decarburization-annealing was unstable. In the present invention, it was also found preferable from the viewpoint of actual operation to establish an upper limit threshold for the hydrated water content of the annealing separator having MgO as the main component. Maintaining the MgO hydrated water content within a specified range has required precise control of the conditions in the production processes and has further required strict control of annealing separator storage between manufacture and use. However, the present invention achieves good glass film formation by defining the upper limit of annealing separator hydrated water content as 2.0% or less. In addition, the lower limit of hydrated water content may be defined as 0.5% in order to maintain the quality of the oxide-film up to the time that formation of the glass film begins.

Also in the case of the oxide-film formed by the decarburization-annealing process of the present invention, addition of chlorine to the annealing separator promotes glass film formation and contributes considerably to magnetic property improvement and glass film defect reduction. In the case of the oxide-layer obtained by ordinary decarburization-annealing, chlorine may, depending on the finish annealing conditions, cause harmful effects such as excessive oxidation. On the other hand, this problem can be minimized to achieve synergistic formation of an excellent glass film by, as in the present invention, adding chlorine to the annealing separator to a total content of 0.020 to 0.080% in the process for forming a dense oxide-film. When the chlorine total content of the annealing separator is less than 0.020%, the effect is small, and when it exceeds 0.080%, glass film formation is impossible even with the oxide-film of the present invention. The chlorine added to the annealing separator can be in the form of a chlorine compound such as HCl, $FeCl_3$, $MgCl_2$, $SbCl_3$ or the like, or in the form of a substance such as $Sb_2(SO_4)_3$ that contains chlorine as an impurity.

In the present invention, the relationship between the hydrated water content and chlorine content is prescribed by the ranges shown below:

$$Clmax(\%)=-0.04\times\text{hydrated water content}+0.1,$$

$$Clmin(\%)=-0.04\times\text{hydrated water content}+0.06,$$

$$0.5\%\leqq\text{hydrated water content}\leqq 2.0(\%),\text{ and}$$

$$0.020\%\leqq\text{chlorine}\leqq 0.080\%.$$

Satisfying these conditions enables the forsterite formation reaction to occur throughout the coil without becoming either insufficient or excessive, whereby the desired magnetic properties and glass film properties can be achieved simultaneously.

EXAMPLES

Example 1

Molten steel comprising, in mass %, C, 0.068%, Si: 3.35%, acid-soluble Al: 0.0260%, N: 0.0046%, Mn: 0.045%, S: 0.014%, Sn: 0.15%, Cu: 0.09% and Ti: 0.0020% was cast by an ordinary method. Inhibitor substances in the cast slab were completely dissolved into solid solution at a slab heating temperature of 1310° C., whereafter the slab was hot rolled and rapidly cooled to obtain a 2.2 mm hot-rolled steel strip. The precipitation rate of AlN was not greater than 10%. The strip was then subjected to 1120° C.×10 sec annealing, followed by holding at 900° C. for 2 min and water cooling from 750° C. After pickling, the strip was subjected to rolling to a thickness of 0.220 mm, including three 250° C. aging treatment cycles, using a reverse cold rolling mill. The strip was degreased and then subjected to primary recrystallization/decarburization-annealing for 110 sec at 850° C. in an atmosphere of $N_2$: 25%, $H_2$: 75%, followed by no latter-part annealing or 875° C.×15 sec annealing under condition of oxygen concentration of 400 to 850 ppm calculated based on strip thickness of 0.30 mm. Thereafter, the strip was nitrided while traveling through an ammonia atmosphere so as to have a post-nitriding nitrogen content of 0.0190 to 0.021%. The nitrided strip was coated with annealing separator that had a hydrated water content of 1.5% and was added with 0.04% chlorine. Next, secondary recrystallization annealing was conducted under respective conditions at a temperature increase rate of 15° C./hr up to 1200° C., whereafter purification annealing was conducted for 20 hours at 1200° C. in and atmosphere of $H_2$: 100%. Ordinary coating with tension-imparting insulating coating and flattening were then conducted. The results are shown in Table 1. A glass film defect rate of 2.0% or less and a magnetic flux density B8 (T) of 1.940 T or greater were rated "good."

TABLE 1

Examples & Comparative Examples of 0.22 mm steels

| | | Decarburization-Annealing conditions | | | | Post-decarburization annealing | Secondary recrystallization annealing conditions | | | | Magnetic properties | |
|---|---|---|---|---|---|---|---|---|---|---|---|---|
| | | Former part | | Latter part | | oxygen based on 0.30 mm sheet thickness | Atmosphere $N_2$% (Bal $H_{2\%}$) | | | Glass film defect rate | Flux density | Core loss |
| Example type | No. | Dp (° C.) | $PH_2O/PH_2$ | Dp (° C.) | $PH_2O/PH_2$ | Ppm | ~950° C. | $PH_2O/PH_2$ ~950° C. | 950° C.~ | % | B8 T | W17/50 W/kg |
| Comparative | 1 | 64 | 0.41 | None | — | 500 | 50 | 0.08 | 0.001 | 3.0 | 1.951 | 0.77 |
| Invention | 2 | 64 | 0.41 | 48 | 0.17 | 500 | 50 | 0.08 | 0.001 | 0.7 | 1.948 | 0.80 |
| Invention | 3 | 64 | 0.41 | 36 | 0.08 | 500 | 25 | 0.03 | 0.004 | 0.2 | 1.961 | 0.79 |
| Invention | 4 | 67 | 0.49 | 38 | 0.09 | 575 | 25 | 0.03 | 0.004 | 0.2 | 1.955 | 0.78 |
| Invention | 5 | 67 | 0.49 | 20 | 0.03 | 575 | 50 | 0.02 | 0.004 | 0.5 | 1.946 | 0.81 |
| Invention | 6 | 69 | 0.56 | 10 | 0.02 | 650 | 50 | 0.02 | 0.001 | 0.5 | 1.958 | 0.80 |
| Invention | 7 | 69 | 0.56 | 0 | 0.008 | 650 | 65 | 0.10 | 0.001 | 0.2 | 1.941 | 0.79 |
| Invention | 8 | 71 | 0.63 | 0 | 0.008 | 690 | 65 | 0.10 | 0.002 | 0.2 | 1.949 | 0.76 |
| Invention | 9 | 64 | 0.41 | 48 | 0.17 | 500 | 50 | 0.08 | 0.05 | 1.9 | 1.945 | 0.82 |
| Invention | 10 | 67 | 0.49 | 38 | 0.09 | 575 | 25 | 0.03 | 0.05 | 1.7 | 1.947 | 0.83 |
| Invention | 11 | 67 | 0.49 | 20 | 0.03 | 575 | 50 | 0.02 | 0.06 | 1.8 | 1.958 | 0.81 |
| Invention | 12 | 71 | 0.63 | 0 | 0.008 | 690 | 65 | 0.10 | 0.06 | 2.0 | 1.962 | 0.85 |
| Comparative | 13 | 58 | 0.29 | 36 | 0.08 | 400 | 50 | 0.08 | 0.001 | 8.9 | 1.960 | 0.85 |

TABLE 1-continued

Examples & Comparative Examples of 0.22 mm steels

| Example type | No. | Decarburization-Annealing conditions: Former part Dp (° C.) | Former part $PH_2O/PH_2$ | Latter part Dp (° C.) | Latter part $PH_2O/PH_2$ | Post-decarburization annealing oxygen based on 0.30 mm sheet thickness Ppm | Secondary recrystallization annealing conditions: Atmosphere $N_2$% (Bal $H_{2\%}$) ~950° C. | $PH_2O/PH_2$ ~950° C. | $PH_2O/PH_2$ 950° C.~ | Glass film defect rate % | Magnetic properties: Flux density B8 T | Core loss W17/50 W/kg |
|---|---|---|---|---|---|---|---|---|---|---|---|---|
| Comparative | 14 | 73 | 0.72 | 38 | 0.09 | 750 | 50 | 0.08 | 0.001 | 2.0 | 1.830 | 1.10 |
| Comparative | 15 | 74 | 0.77 | 0 | 0.008 | 850 | 25 | 0.03 | 0.004 | 0.9 | Poor secondary recrystallization | |
| Comparative | 16 | 64 | 0.41 | None | — | 500 | 25 | 0.03 | 0.004 | 10.6 | 1.950 | 0.82 |
| Comparative | 17 | 69 | 0.56 | 10 | 0.02 | 650 | 80 | 0.08 | 0.001 | 3.7 | 1.930 | 0.81 |
| Comparative | 18 | 69 | 0.56 | 0 | 0.008 | 650 | 80 | 0.08 | 0.001 | 2.1 | 1.925 | 0.82 |
| Comparative | 19 | 71 | 0.63 | 0 | 0.008 | 690 | 10 | 0.03 | 0.001 | 5.7 | Poor secondary recrystallization | |

Example 2

The cold-rolled steels of Example 1 were used. $PH_2O/PH_2$ in the latter part of the decarburization-annealing was made 0.008 to 0.30, oxygen concentration calculated based on strip thickness of 0.30 mm was made 550 to 650 ppm, and post-nitriding nitrogen content was made 0.0190% to 0.0215%. Each strip was then coated with annealing separator containing 0.045% chlorine and 1.0% hydrated water. Next, ordinary secondary recrystallization annealing was conducted in an atmosphere of 50% hydrogen, 50% nitrogen at a temperature increase rate of 15° C./hr up to 1200° C. $PH_2O/PH_2$ at the hottest point of the secondary recrystallization annealing was made 0.0002 to 0.17. The resulting glass film defect rates are shown in FIG. 1. As can be seen from FIG. 1, the effect of the present invention was observed. The plots enclosed by the broken line on the right side of FIG. 1 are those of examples that were good in film defect rate but had low-level magnetic flux density.

Example 3

Figure 2:
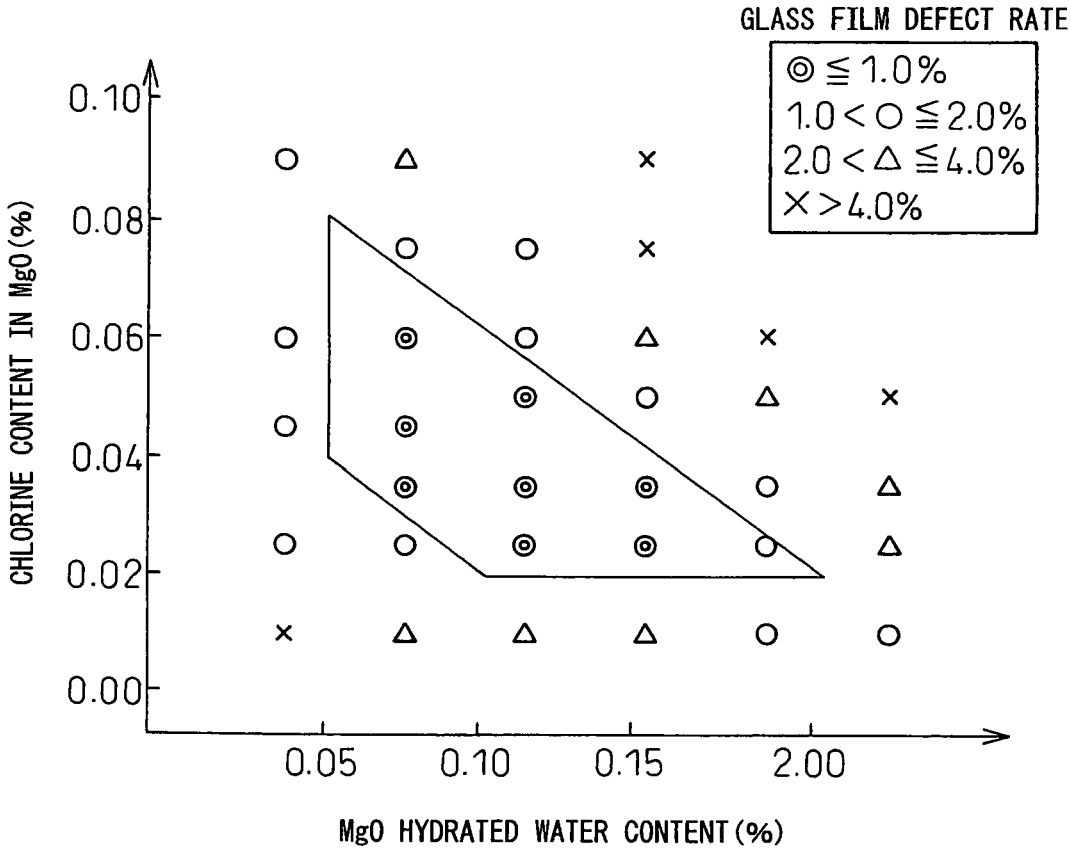
FIG. 2 is a diagram showing hydrated water content and chlorine content of annealing separator, and their relationship to glass film defect rate.

Molten steel comprising, in mass %, C: 0.065%, Si: 3.30%, acid-soluble Al: 0.0265%, N: 0.0045%, Mn: 0.047%, S: 0.014%, Sn: 0.10%, Cu: 0.05% and Ti: 0.0018% was cast by an ordinary method. Inhibitor substances in the resulting slab were completely dissolved into solid solution at a slab heating temperature of 1300° C., whereafter the slab was hot rolled and rapidly cooled to obtain a 2.3 mm hot-rolled steel strip. All AlN precipitation rates were 10% or less. The strip was then subjected to 1120° C.×10 sec annealing, followed by holding at 900° C. for 2 min, air cooling to 750° C. and water cooling. After pickling, the strip was subjected to rolling to a thickness of 0.285 mm, including three 250° C. aging treatment cycles, using a reverse cold rolling mill. The strip was degreased and then subjected to primary recrystallization/decarburization-annealing for 150 sec at 850° C. in an atmosphere of $N_2$: 25%, $H_2$: 75%, dew point: 65° C. ($PH_2O/PH_2$: 0.437) followed by 875° C.×15 sec annealing at dew point 36° C. ($PH_2O/PH_2$: 0.08), the oxygen concentration calculated based on strip thickness of 0.30 mm being made 600 ppm to 650 ppm. Thereafter, the strip was nitrided while traveling through an ammonia atmosphere so as to have a post-nitriding nitrogen content of 0.0190 to 0.0210%. The nitrided strip was coated with annealing separator that had a hydrated water content of 0.04% to 2.2% and a chlorine content of 0.01% to 0.09%. Next, $PH_2O/PH_2$: 0.13 was established up to 950° C. in an atmosphere of 50% nitrogen, the balance hydrogen, whereafter the temperature was increased up to 1200° C. at 15° C./hr under conditions of $H_2$: 75%, $PH_2O/PH_2$: 0.005. Purification annealing was then conducted in an atmosphere of $H_2$: 100%, followed by cooling. Ordinary coating with tension-imparting insulating coating and flattening were then conducted. The glass film defect rates in this case are shown in FIG. 2. As shown, very good film defect rates were achieved by regulating chlorine and hydrated water content. In addition the sheets also exhibited excellent magnetic properties, specifically, flux density, B8 of 1.940 to 1.965 T, and core loss, W17/50, of 0.920 to 0.965 W/kg.

What is claimed is:

1. A method of producing a grain-oriented electrical steel sheet having excellent magnetic properties comprising the steps of:

heating a steel slab consisting essentially of, in mass %, C: 0.025 to 0.09%, Si: 2.5 to 4.0%, acid-soluble Al: 0. 022 to 0.033%, N: 0.003 to 0.006%, 0.008 to 0.018% of S equivalent (Seq) with Seq =S+0.405Se, Mn: 0.03 to 0.10%, Ti≦0.005%, and a balance of Fe and unavoidable impurities, to a temperature of 1280° C. or more;

hot-rolling the heated steel slab into a hot-rolled steel strip;

optionally conducting hot-rolled steel strip annealing;

cold rolling the hot-rolled steel strip to a final sheet thickness by a plurality of rolling passes with intermediate annealing or heat-treating the cold rolled steel strip one or more times before final cold-rolling and having a final cold-rolling reduction ratio of 83% to 92%;

decarburization-annealing the cold rolled steel strip combined with primary recrystallization, wherein $PH_2O/PH_2$ in the first half part of the decarburization annealing is controlled to 0.30 to 0.70 with soaking at a temperature of 810 to 890° C. for 60 to 200 seconds and $PH_2O/PH_2$, in the last half part of the decarburization annealing is controlled to 0.20 or less, thereby making the circular equivalent average grain diameter of the primary recrystallization grains 7 μm to less than 18μm; and controlling the oxygen concentration (So) contained in the decarburized steel strip to 450 to 700 ppm, where So is calculated based on a steel strip having a thickness of 0.30 mm, nitriding the decarburized steel strip as it travels in a mixture of hydrogen, nitrogen and ammonia until the total nitrogen content in the nitrided steel strip after nitriding is at 0.013 to 0.024%;

coating an annealing separator composed of MgO onto the nitrided steel strip; and secondary recrystallization annealing the coated steel strip in a coiled form such that, when the temperature at a hottest coil outer periphery point is between room temperature and 950° C., $PH_2O/PH_2$ is controlled to 0.01 to 0.15 in a hydrogen atmosphere containing 25 to 75% of nitrogen, or when the temperature of the hottest coil outer periphery point exceeds 950° C. during secondary recrystallization annealing $PH_2O/PH_2$ is controlled to less than 0.01;

where So is the numerical value obtained by multiplying the actual oxygen analysis value S (ppm) by t /0.30, namely, So (ppm) =S×t /0.30, and where t (mm) is the actual steel strip thickness.

2. The method of producing a grain-oriented electrical steel sheet having excellent in magnetic properties according to claim 1, wherein when the temperature of the hottest coil outer periphery point exceeds 950° C. during secondary recrystallization annealing, $PH_2O/PH_2$ is controlled to less than 0.01.

3. The method of producing a grain-oriented electrical steel sheet having excellent in magnetic properties according to claim 1, wherein the steel slab further comprises, in mass%, one or more of Cu: 0.05 to 0.30%, Sn: 0.02 to 0.30%, Sb: 0.02 to 0.30%, P: 0.02 to 0.30%, Cr: 0.02 to 0.30%, Ni: 0.008 to 0.3%, Mo: 0.008 to 0.3% and Cd: 0.008 to 0.03%.

4. The method of producing a grain-oriented electrical steel sheet having excellent magnetic properties according to claim 1, wherein a hydrated water content of the annealing separator is 2.0% or less.

5. The method of producing a grain-oriented electrical steel sheet having excellent magnetic properties according to claim 1, wherein a chlorine compound is added to the annealing separator until the total chlorine content is at 0.020 to 0.080 mass %.

6. The method of producing a grain-oriented electrical steel sheet having excellent magnetic properties according to claim 4 or 5, wherein the relationship between the hydrated water content and the chlorine content of the annealing separator satisfies the following equations:

$$Clmax\ (mass\%) = 0.04 \times \text{hydrated water content} + 0.1,$$

$$Clmin\ (mass\%) = 0.04 \times \text{hydrated water content} + 0.06,$$

$$0.5\ mass\% \leqq \text{hydrated water content} \leqq 2.0\ (mass\%), \text{ and}$$

$$0.020\ mass\% \leqq \text{chlorine} \leqq 0.080\ mass\%.$$

7. The method of producing a grain-oriented electrical steel sheet having excellent magnetic properties according to claim 1, wherein when the temperature of the hottest coil outer periphery point during secondary recrystallization annealing is between room temperature and 950° C., $PH_2O/PH_2$ is controlled to 0.01 to 0.15.

* * * * *